US005507660A

United States Patent [19]

Jalliffier

[11] Patent Number: 5,507,660

[45] Date of Patent: Apr. 16, 1996

[54] ELECTRICAL CONNECTION SYSTEM

[75] Inventor: Francois Jalliffier, Genas, France

[73] Assignee: GEC Alsthom Transport SA, Paris, France

[21] Appl. No.: 266,456

[22] Filed: Jun. 27, 1994

[30] Foreign Application Priority Data

Jun. 28, 1993 [FR] France ..... 93 07843

[51] Int. Cl.[6] ..... H01R 13/629

[52] U.S. Cl. ..... 439/197; 91/35; 439/310

[58] Field of Search ..... 439/132, 197, 439/310; 62/448, 237, 240, 243; 91/35, 43; 92/24; 60/540

[56] References Cited

U.S. PATENT DOCUMENTS

| | | | |
|---|---|---|---|
| 1,488,473 | 4/1924 | Brown | 439/132 |
| 2,580,353 | 12/1951 | Hunt | 91/35 |
| 3,180,234 | 4/1965 | Crawley et al. | 92/24 |
| 4,959,020 | 9/1990 | Di Rosa | 439/131 |
| 5,071,364 | 12/1991 | Bourgie | 439/310 |

FOREIGN PATENT DOCUMENTS

| | | |
|---|---|---|
| 0311171A1 | 4/1989 | European Pat. Off. . |
| 2644070A1 | 4/1978 | Germany . |
| 3151560A1 | 9/1983 | Germany . |
| 277729A1 | 4/1990 | Germany . |

*Primary Examiner*—Neil Abrams
*Attorney, Agent, or Firm*—Sughrue, Mion, Zinn, Macpeak & Seas

[57] ABSTRACT

An electrical connection system is implemented while storage units are being loaded onto a transportation bed 2 or while they are being unloaded therefrom. The system includes an electrical connection constituted by at least one male-type connector 4, 5 and by at least one female-type connector 5, 4, one of the connectors being fixed to the transportation bed 2 or to the storage unit 1, the other connector being driven by a positioning element 6 fixed to the storage unit 1 or to the transportation bed 2, respectively. A control system fixed to the storage unit 1 or to the transportation bed 2 includes a time-delay piston 8 or equivalent time-delay element enabling the positioning element to be controlled.

1 Claim, 4 Drawing Sheets

7
15
10
11
12
13
17
8
18
16
20
9
6
14
19
5
1
2
4

ELECTRICAL CONNECTION SYSTEM

The present invention relates to electrical connection systems in general, and, more particularly, it concerns electrical connection systems that can be disposed on storage units, of the container or box type, used in transporting perishables by air, sea, rail, or road.

BACKGROUND OF THE INVENTION

The perishables market requires very high quality transportation. To achieve such very high quality, a certain number of requirements must be satisfied. In particular storage units must be used so as to achieve high-performance transportation that guarantees continuity in the "cold chain". The perishables market increasingly uses thermal protection because of regulatory constraints or of technical constraints such as pre-refrigerating certain fruits and vegetables. The transportation must therefore be performed by means of a vehicle that satisfies the technical standards with respect to maintaining the storage unit at a constant temperature, and with respect to the characteristics of the refrigerating set.

In the state of the art, the continuity of the cold chain is guaranteed by installing and using manual-type electrical connectors. Such manual electrical connectors are disposed in part on the units and in part on the bed of the transportation means or on the stationary bed for storing the storage units.

A major drawback of prior art electrical connectors is that they must be connected and disconnected manually, and there is therefore a considerable risk that the electrical connectors might be torn off during loading and/or unloading of the storage units.

Another major drawback of prior art manual electrical connectors is that they lack flexibility, and that time is lost during each handling operation.

Furthermore, it is well known that any manual operation involving electrical connectors presents a major risk for the people performing the operation.

OBJECTS AND SUMMARY OF THE INVENTION

An object of the present invention is to provide an electrical connection system that does not suffer from the drawbacks of state-of-the-art apparatus.

Another object of the present invention is to provide an electrical connection system that does not interfere with already-existing standard mechanical fixing or positioning systems, stowage means, and clamp engagement means.

The invention therefore provides an electrical connection system implemented while storage units are being loaded onto a transportation bed or while they are being unloaded therefrom.

According to the invention, the electrical connection system comprises firstly electrical connection means constituted by at least one male-type connector and by at least one female-type connector, one of the connectors being fixed to the transportation bed or to the storage unit, the other connector being driven by a positioning element fixed to the storage unit or to the transportation bed, respectively, and secondly control means fixed to the storage unit or to the transportation bed, the control means enabling the positioning element to be actuated so as to establish electrical connection between said connectors and including delay-type elements so that, during loading of the storage unit, the positioning element for positioning the moving electrical connector is actuated only after said storage unit has been positioned on the transportation bed in a pre-established position;

An advantage of the connection apparatus of the invention is that it is automatic.

Another advantage of the connection apparatus is that the electrical connection is performed after a time lag.

BRIEF DESCRIPTION OF THE DRAWINGS

A preferred embodiment of the electrical connection system of the invention is described below with reference to the accompanying drawings, in which.

MORE DETAILED DESCRIPTION

Figure 1:
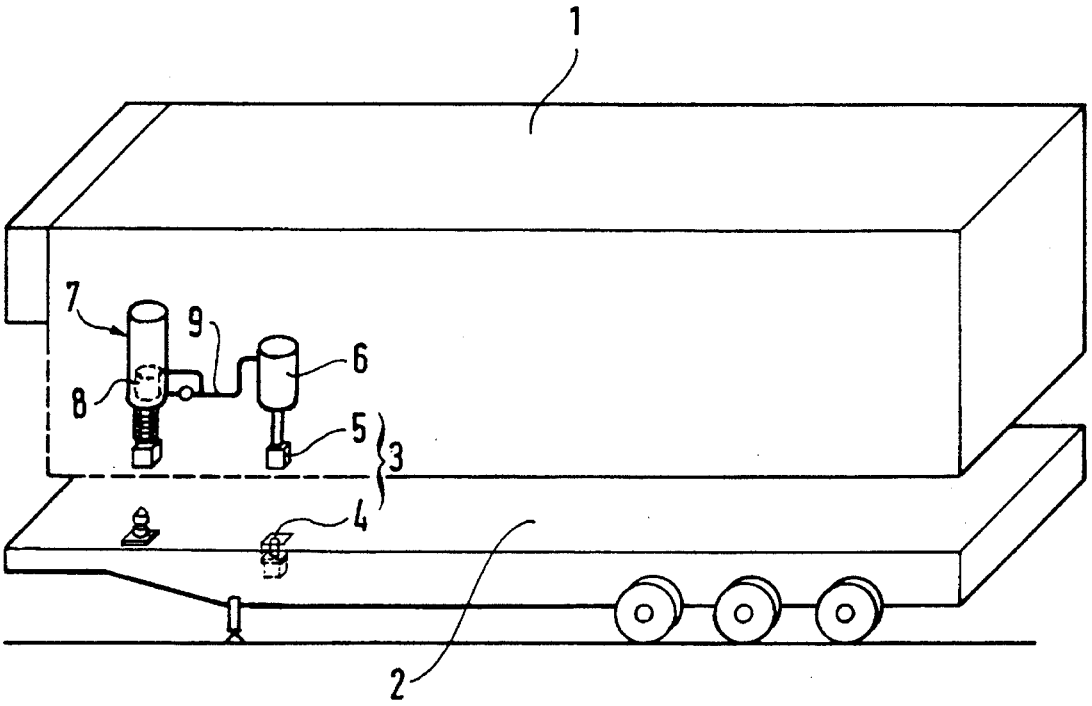
FIG. 1 is a diagrammatic perspective view of an electrical connection system of the invention.

The electrical connection system shown in FIG. 1 comprises electrical connection means 3 and control means 7. The electrical connection means 3 are constituted by at least one male-type connector 4 or 5, and by at least one female-type connector 5 or 4. One of the connectors 4 is fixed to the transportation bed 2 or to the storage unit 1. The other connector 5 is driven by a positioning element 6 that is fixed to the storage unit 1 or to the transportation bed 2. The control means 7, fixed to the storage unit 1 or to the transportation bed 2, make it possible to control the positioning element 6 that is associated with the control means so as to establish an electrical connection by means of said connectors 4 and 5. The control means 7 are connected to the positioning element 6 by means of connection elements 9. The control means 7 include a time delay-type element or time delay piston 8 so that, during loading of the storage unit 1, the positioning element 6 for positioning the moving electrical connector 4 or 5 is actuated only after said storage unit 1 has been positioned on the transportation bed in a pre-established position.

While the storage unit 1 is being loaded onto the transportation bed 2, and since the control means 7 are connected to the positioning element 6 via connection elements 9, said control means are actuated such that the positioning element 6 positions the moving connector 4 or 5 so that it abuts against the fixed connector 5 or 4. The way in which the mechanical connections and then the electrical connections are obtained is described below in more detail for a hydraulic-type embodiment of the control means 7.

Figure 2:
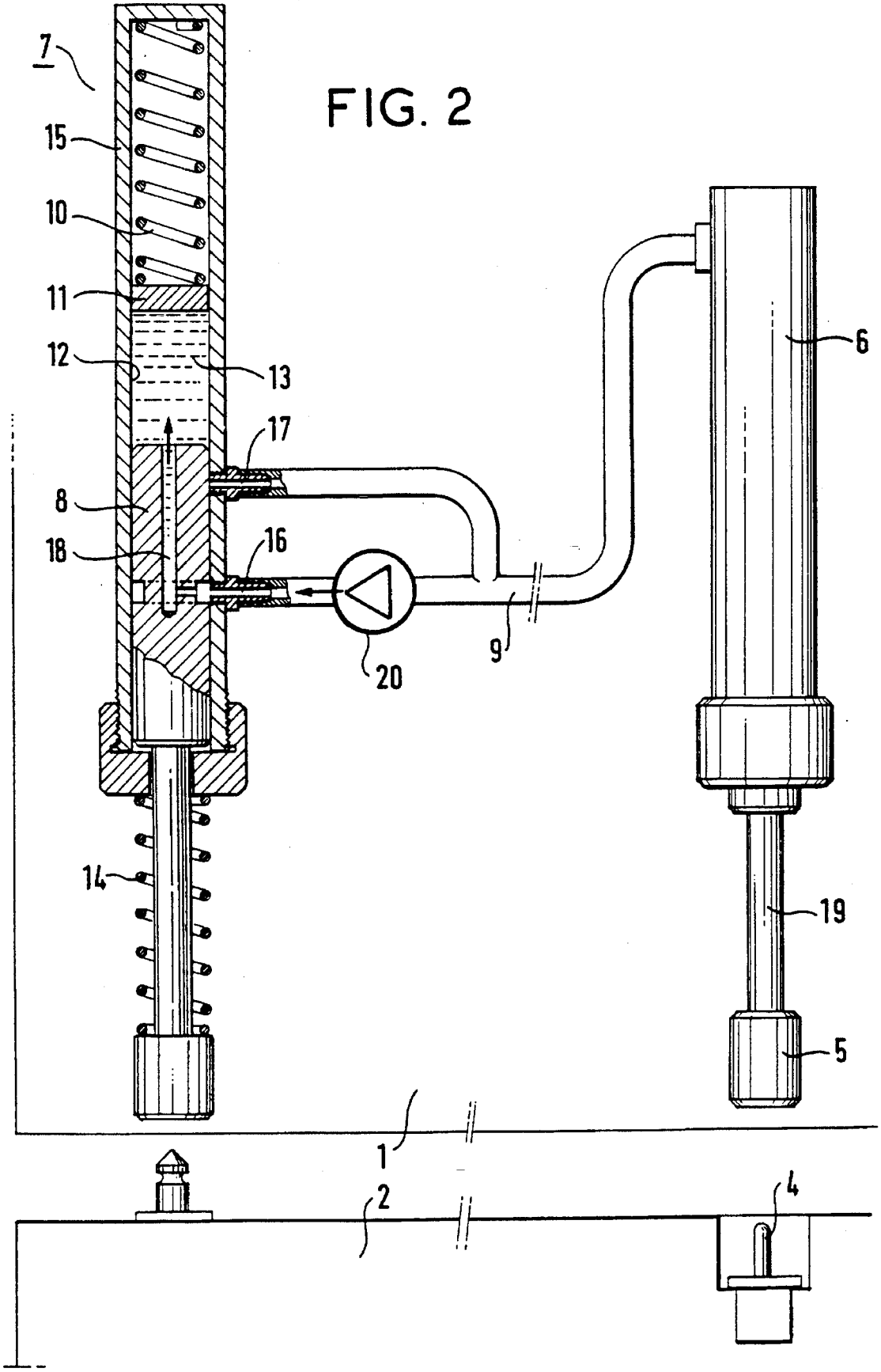
FIG. 2 is a diagrammatic view partially in section of the electrical connection system of the invention.

FIG. 2 is a diagrammatic view partially in section showing a preferred embodiment of the control means 7 in the rest position and connected to the associated positioning element 6. The rest position is obtained when the storage unit is unloaded from the transportation bed. The time-delay piston 8 described below is then in the low position inside the body of the distributor cylinder 15. In this embodiment, the control means 7 are of the hydraulic type and comprise a spring 10, a floating piston 11, a chamber 12 containing a fluid 13, a time-delay piston 8, the resulting assembly being disposed inside the body of the distributor cylinder 15 so as to form hydraulic distributor apparatus, and a return spring 14 disposed along the external rod of the time-delay piston 8. The chamber 12 is delimited by the space contained inside the body of the distributor cylinder 15, by the floating piston 11 and by the time-delay piston 8. The floating piston 11 is held by the spring 10 at one end and by the fluid 13 at the other end, so that the fluid is compressed.

The body of the distributor cylinder 15 is provided with an inlet nozzle 16 and with an outlet nozzle 17 for the fluid 13. In the above-defined rest position, the chamber 12 is connected to the inlet nozzle 16 via a channel 18 provided in the body of the time-delay piston 8, and extending longitudinally from the chamber 12 and then transversely to the inlet nozzle 16.

For example, the positioning element 6 may be a single-chamber hydraulic actuator having its piston 19 secured to the female connector 5.

To prevent a portion of the fluid 13 contained in chamber 12 from being injected prematurely into the chamber of the positioning element 6, the inlet nozzle 16 is connected to a non-return valve 20 (cf FIG. 2) that allows the fluid 13 to flow only from the positioning element 6 to the inlet nozzle 16.

Figure 3:
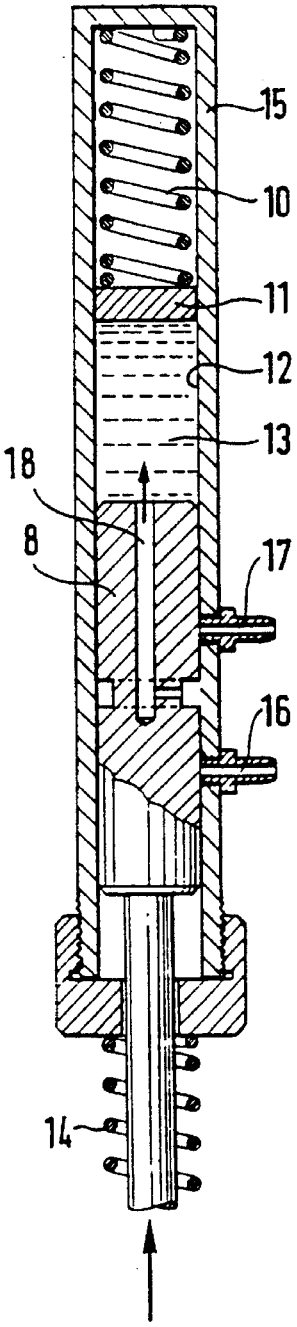
FIGS. 3 to 7 are section views of a preferred embodiment of hydraulic-type control means shown in characteristic positions.
Figure 4:
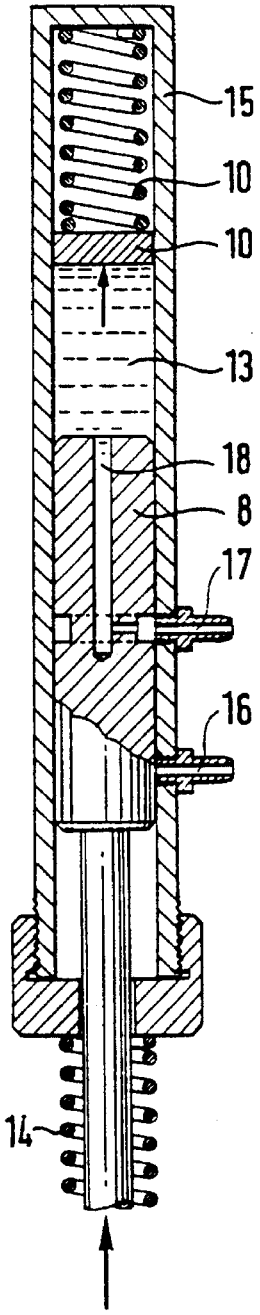
Figure 5:
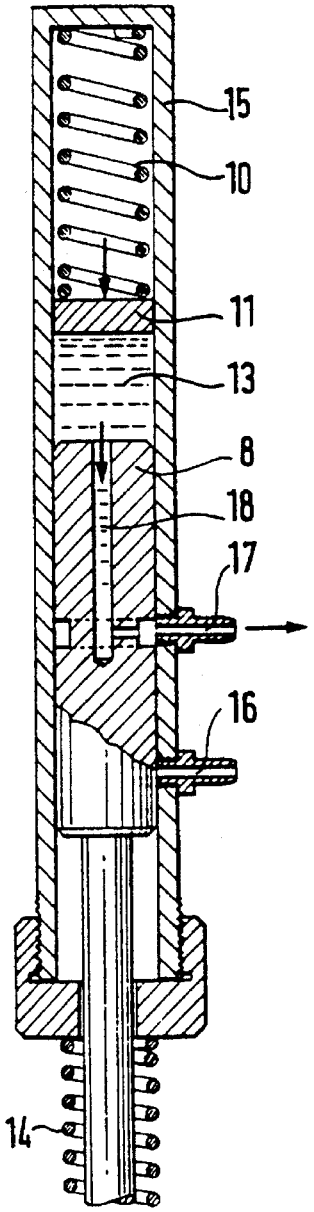
Figure 6:
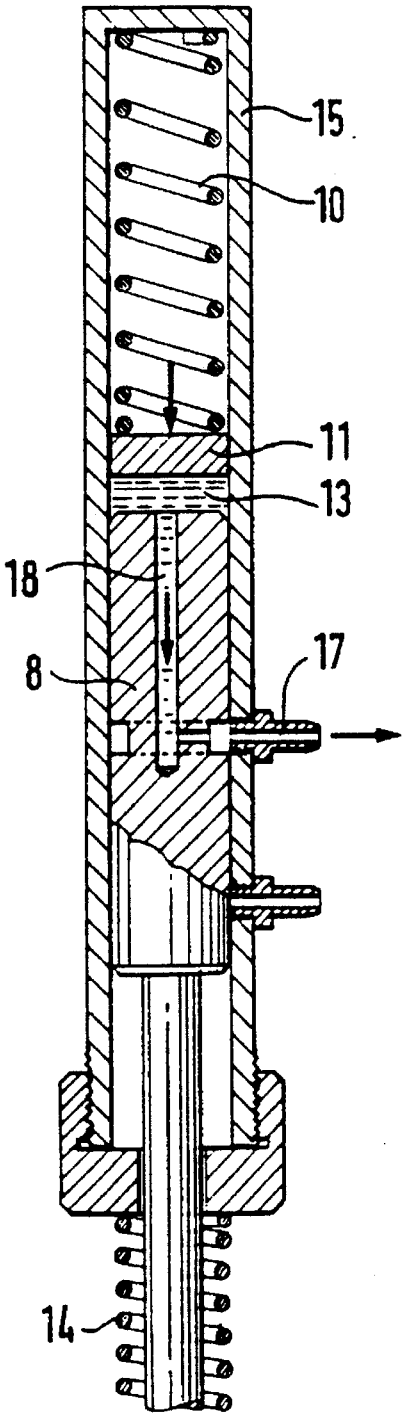

When the storage unit 1 is being loaded onto the transportation bed 2, the time-delay piston 8 is actuated first, and it penetrates into the body of the distributor cylinder 15 (FIG. 3) so that it is positioned in the high position (FIG. 4). The feed channel 18, which is open to the chamber 12 and initially open to the inlet nozzle 16, is positioned facing the outlet nozzle 17. The fluid 13, compressed by the spring 10 and by the time-delay piston 8 which is in the high position inside the distributor cylinder 15, is injected into the chamber of the positioning element 6 which is not shown (FIGS. 5 and 6). The injection of fluid 13 into the chamber of the hydraulic actuator causes the female connector 4 or 5 to be displaced until it is in contact with the male connector 5 or 4.

Figure 7:
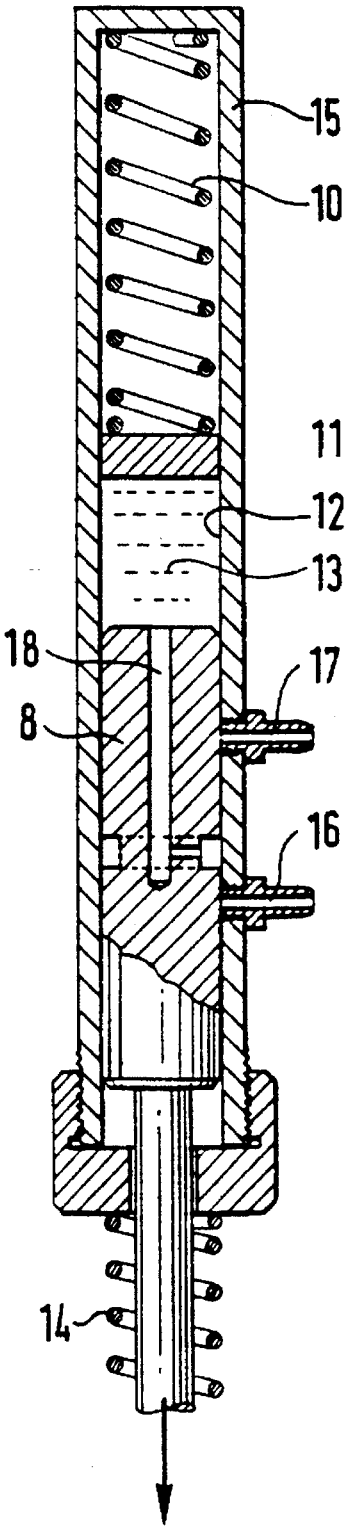

While the storage unit 1 is being unloaded from the transportation bed 2, the time-delay piston 8 is actuated and is displaced under the action of the return spring 14 to the low position in the distributor cylinder body 15 (FIG. 7). The feed channel 18, open to the chamber 12 and previously open to the outlet nozzle 17, is positioned facing the inlet nozzle 16.

The fluid 13 in the chamber of the positioning element 6 is sucked into chamber 12 by the suction created in chamber 12 as a result of the time-delay piston 14 being displaced from its high position to its low position. The fluid 13 is also flushed into the chamber 12 in the body of the distributor cylinder 15 under the effect of the single-acting type actuator being automatically returned to its rest position.

As a result, the piston 19 of the positioning element is returned to its initial position and the connectors 4 and 5 are no longer electrically connected together (cf FIG. 2).

In general, the displacement speed of the floating piston 11 is a function of the handling system used for handling the storage unit 1. The reverse displacement speed of the floating piston during injection of the fluid 13 into the chamber 12 of the positioning element 6 is a function of the inside diameter of the outlet nozzle 17 and of the pressure applied by the spring 10 on the fluid 13 via the floating piston 11. The stroke of the piston 19 of the positioning element 6 is a function of the diameter of the chamber of the positioning element, and of the volume of oil injected into the chamber.

By way of example, the gap between the inlet nozzle 16 and the outlet nozzle 17 is about 15 mm.

Naturally, the electrical connectors 4 and 5 are connected, e.g. by means of electrical cables (not shown) respectively to a refrigerating set (not shown), e.g. fixed to the storage unit 1, and to an electrical power source (not shown), e.g. fixed to the transportation bed 2.

The connection system described may be used on any type of storage unit, and on any type of stationary bed or on any type of transportation bed.

The connectors 4 and 5 are supported by a mechanical system (not shown) for automatically taking up any misalignment. Such misalignment is about plus or minus 30 mm because it is limited by the relative positions of the axis of the retaining pin on the transportation bed 2 relative to the axis of the corner piece on the storage unit 1.

I claim:

1. An electrical connection system implemented while storage units are being loaded onto a transportation bed or while they are being unloaded therefrom, said system comprising:

electrical connection means constituted by at least one male-type connector and by at least one female-type connector, one of the connectors being fixed to the transportation bed or to the storage unit, the other connector being driven by a positioning element fixed to the storage unit or to the transportation bed, respectively; and control means fixed to the storage unit or to the transportation bed, said control means comprising actuating means for actuating the positioning element to establish electrical connection between said connectors and including delay-type elements so that, during loading of the storage unit, the positioning element for positioning the driving electrical connector is actuated only after said storage unit has been positioned on the transportation bed in a pre-established position;

said positioning element being connected to said control means by means of connection elements, and wherein said control. means comprises a hydraulic distributor apparatus including a hydraulic distributor cylinder housing in order, an internal spring, a floating first piston, a chamber containing a fluid, a time delay piston constituting said time delay element, and forming an assembly disposed inside a body of said distributor cylinder, and a return spring disposed along an external rod of the time delay piston; and wherein said positioning element is constituted by a single chamber hydraulic actuator having a second piston secured to the male connector or to the female connector, said single chamber being connected to the control means by means of hydraulic connectors by said connection elements, and by means of an inlet nozzle and an outlet nozzle for said fluid, and said nozzles being provided in the body of the distributor cylinder with said inlet nozzle being connected to the connection elements via a non-return valve.

* * * * *